US005339543A

United States Patent [19]

Lin

[11] Patent Number: 5,339,543

[45] Date of Patent: Aug. 23, 1994

[54] SHOE

[76] Inventor: Nan-Sun Lin, 1-47, Tu - Ku, Tu-Ku Tsuen, Ren-Te Shiang, Tainan Shien, Taiwan, 717

[21] Appl. No.: 133,913

[22] Filed: Oct. 12, 1993

[51] Int. Cl.[5] ..... A43B 3/12; A43B 3/24

[52] U.S. Cl. ..... 36/101; 36/100; 36/115; 36/15

[58] Field of Search ..... 36/101, 100, 15, 11.5, 36/36 R, 36 C

[56] References Cited

U.S. PATENT DOCUMENTS

| | | | |
|---|---|---|---|
| 1,160,152 | 11/1915 | Drew | 36/36 C |
| 2,544,878 | 3/1951 | Dratler | 36/36 R |
| 2,651,117 | 9/1953 | Harris | 36/15 |
| 3,154,866 | 11/1964 | Laufbahn | 36/15 |
| 3,204,346 | 9/1965 | Lockard et al. | 36/15 |
| 3,902,259 | 9/1975 | Cracco | 36/101 |
| 4,193,214 | 3/1980 | Wang | 36/101 |
| 4,839,948 | 6/1989 | Boros | 36/101 |
| 4,869,000 | 9/1989 | York, Jr. | 36/101 |
| 4,887,369 | 12/1989 | Bailey et al. | 36/15 |

FOREIGN PATENT DOCUMENTS

| | | | |
|---|---|---|---|
| 308872 | 11/1918 | Fed. Rep. of Germany | 36/15 |
| 495976 | 8/1954 | Italy | 36/15 |
| 594034 | 10/1947 | United Kingdom | 36/15 |

*Primary Examiner*—Steven N. Meyers

[57] ABSTRACT

A shoe comprising a vamp, an inner sole, an outer sole, a heel, and an auxiliary heel combined together. The inner sole has opposing slots and locating holes from combining with the vamp by means of screws and combination of slots and projecting-down sides. The outer sole is adhered with a front and an intermediate portion of the inner sole and also combined together with screws. The heel has three vertical holes for screws to combine the heel with the inner sole, and the auxiliary heel being adhered to the bottom of the heel, all the components being tightly and stably combined with little responsibility of loosening from one another.

1 Claim, 4 Drawing Sheets

SHOE

BACKGROUND OF THE INVENTION

Shoes generally have components joined together with adhesive, so the joints are apt to be easily loosened by rain or by wearing for a long period of time. Therefore, a sole, a heel or a vamp must be repaired, with a resultant loss to a user.

SUMMARY OF THE INVENTION

This invention has been devised to offer a kind of shoe, in which the joining of components such as a vamp, an inner sole, an outer sole, and a heel is achieved by both adhesive and screws. The structure of the shoe is quite stable and firm with little possibility of loosening of jointed components.

A shoe of the present invention comprises a vamp, an inner sole, an outer sole, a high heel and an auxiliary heel assembled together.

The inner sole has a plurality of opposing slots for opposing projecting bottom ends of the vamp to fit through. The bottom ends are then bent to be fixed firmly to the inner sole with screws.

The vamp has two pairs of apposing projecting-down sides to fit through the slots in the inner sole. The sides are bent to be fixed to the inner sole.

The outer sole is adhered with adhesive and fixed firmly with screws. The outer sole covers a large portion of the bottom of the inner sole.

The high heel is fixed with a rear portion of the inner sole by means of screws inserted through three vertical holes in the high heel. The screws fix the high heel to the inner sole.

The auxiliary heel is fixed on the bottom of the high heel, and has three projections on an upper surface to engage three recesses in the bottom of the high heel.

DETAILED DESCRIPTION OF THE INVENTION

Figure 1:
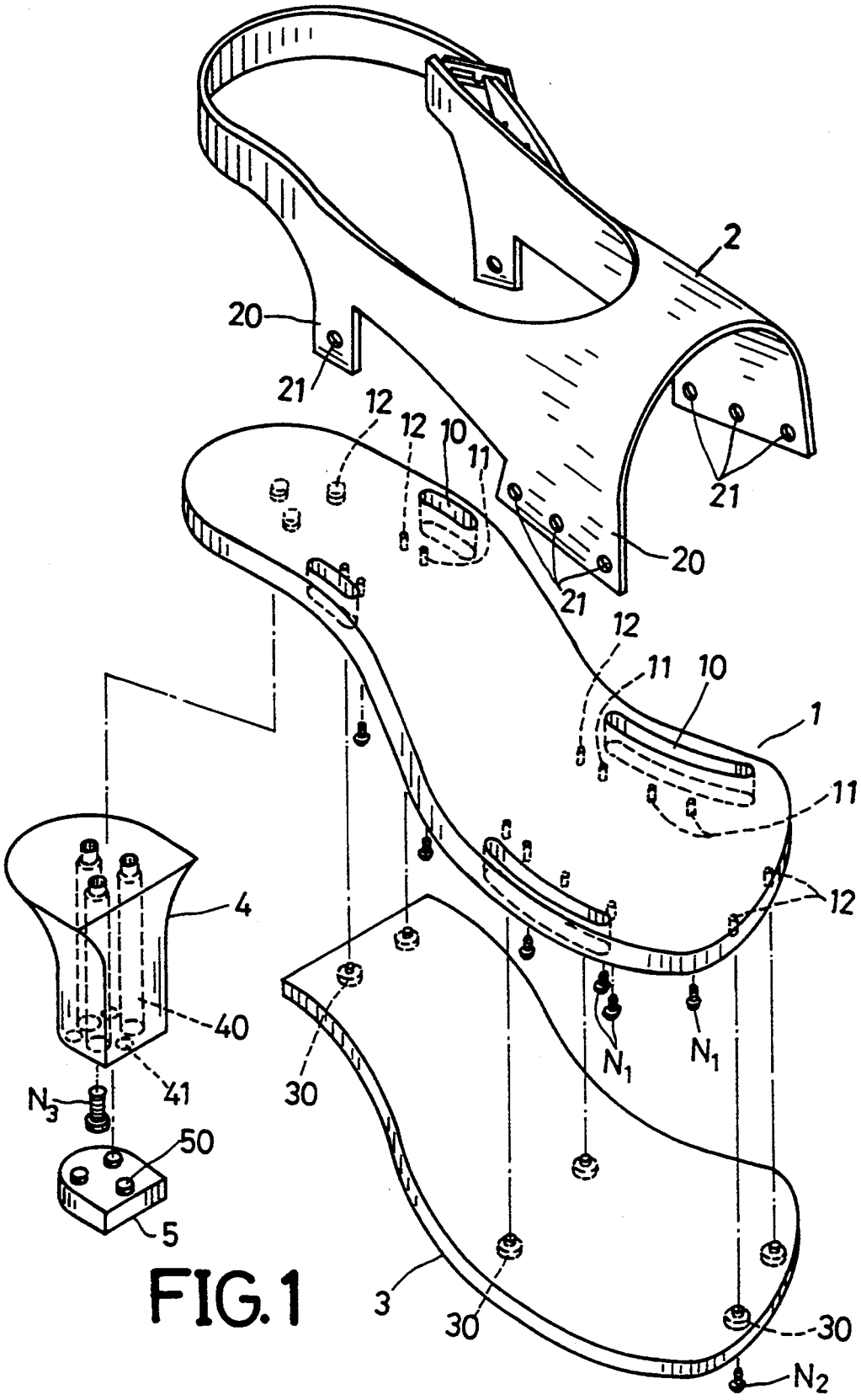
FIG. 1 is an exploded perspective view of a shoe of the present invention.

A shoe of the present invention, as shown in FIG. 1, comprises an inner sole 1, a vamp 2, an outer sole 3, a heel 4, and an auxiliary heel 5 combined together.

The inner sole 1 is shaped like a long rectangle with a curved front end and a curved hind end and sloped down from the hind portion to the front portion to conform to a human sole. The inner sole has two pairs of opposing slots 10. Two opposing long slots are longitudinally in both sides of the front portion, and two opposing short slots are arranged in both sides of the hind portion. Two pairs of opposing locating holes 11, 11 are located in the inner sole 1, and a plurality of connecting holes 12.

The vamp 2 is placed on the inner sole 1, and firmly fixed together with the inner sole 1. The vamp has a front portion curving down from the middle to both sides, three pairs of opposing screw holes 21, a pair of opposing inserting sides 20, 20 in both lower ends of the front portion in corresponding to the slots 10, and locating holes 11 of the inner sole 1, a pair of opposing inserting sides 20 extending down from the intermediate portion, and a lateral hole 21 in each inserting side 20.

The outer sole 3 is combined with a bottom surface of the front portion of the inner sole 1, and has three pairs of screw holes 30 in the front portion, an intermediate portion and a hind portion which correspond to the connecting holes 12 of the inner sole 1.

The heel is combined with a bottom surface of the hind portion of the inner sole 1, and has three vertical through holes 40 spaces apart in the middle portion and three recesses 41 in a bottom surface.

An auxiliary thin heel 5 is adhered to the bottom surface of the heel 4, and has three projections 50 spaced apart on an upper surface to fit into the recesses 41 of the heel 4.

Figure 2:
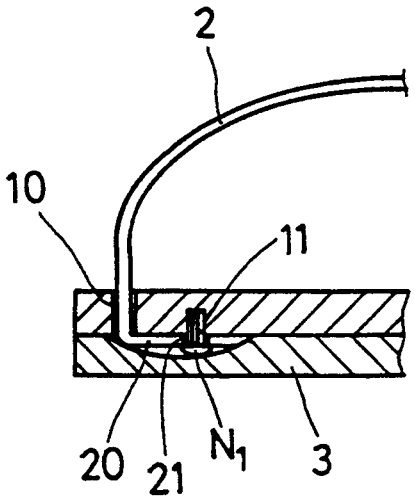
FIG. 2 is a cross-sectional view of a vamp combined with a outer sole and an inner sole in the shoe of the present invention.

In assembling, first, the two pairs of inserting sides 20, are pushed to insert in the slots 10 of the inner sole 1 and are then bent to force the holes 21 of the vamp 2 to align with the related locating holes 11 of the inner sole 1 so that screws N may protrude through the holes 21 to screw into the locating holes 11 of the inner sole 1 as shown in FIG. 2, completing assembly of the inner sole 1 with the vamp 2.

Figure 3:
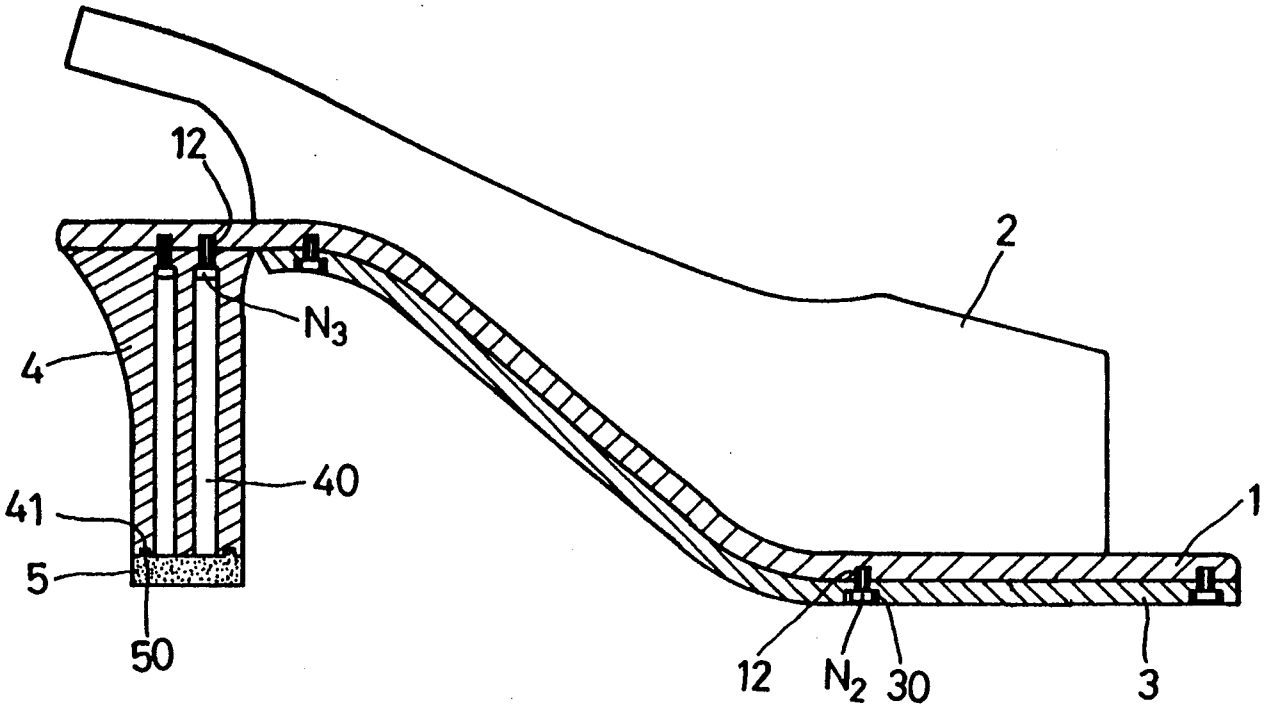
FIG. 3 is a side cross-sectional view of the shoe of the present invention.
Figure 4:
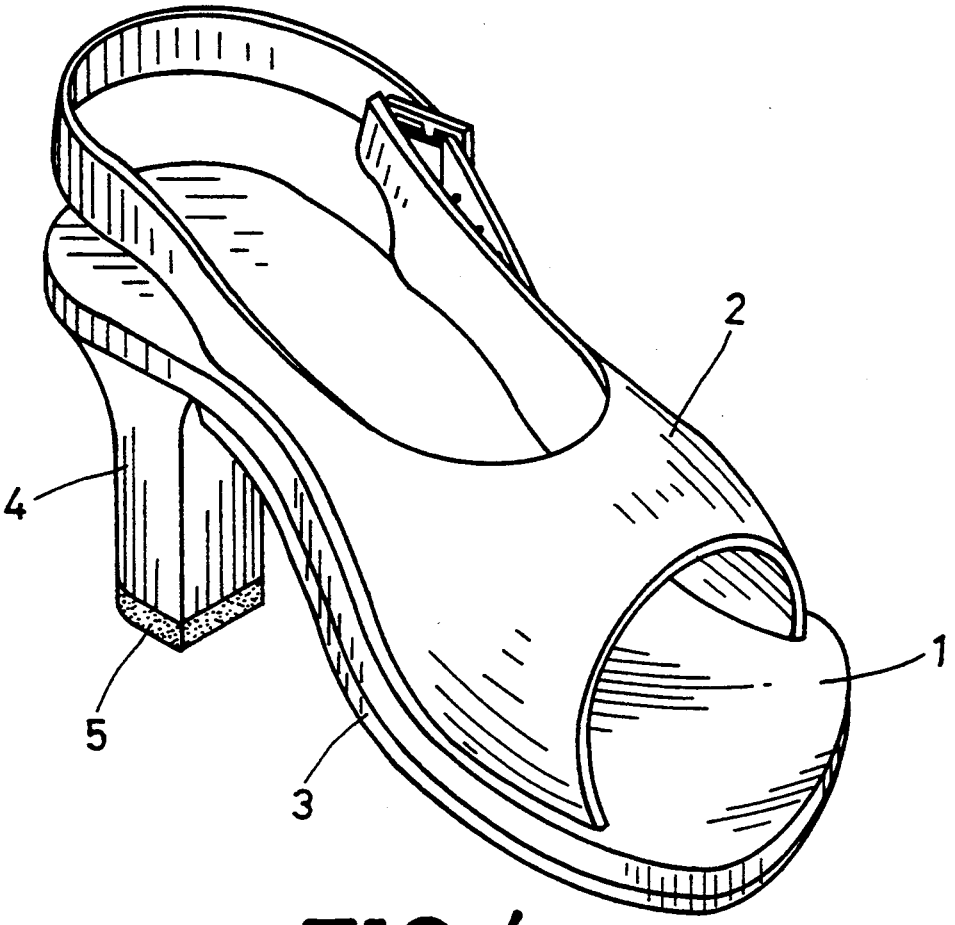
FIG. 4 is a perspective view of the shoe at the present invention.

Next, the outer sole 3 is adhered to the bottom surface of the front portion of the inner sole 1, so that the screw holes 30 are aligned with the related connecting holes 12 of the inner sole 1. Screws N2 are firmly screwed through the holes 30 and the connecting holes 12, as shown in FIG. 3. Thus, the outer sole 3 can prevent sand or water from percolating into the inner sole 1. And the heads of the screws N2 sink in the holes 30, doing no harm to the stability of the inner sole 1. After that, the heel 4 is assembled with the inner sole 1, by aligning the long vertical holes 40 with the connecting holes 12 of the inner sole 1. Screws N3 are screwed with the connecting holes 12 by means of a tool. Lastly, the auxiliary heel 5 is adhered to the bottom surface of the heel 4, letting the projections 50 engage the recesses 41 of the heel 4, as shown in FIG. 3. FIG. 4 shows this shoe completely assembled, having its components connected with each other firmly and stably to endure for a long time.

What is claimed is:

1. A shoe comprising:

An inner sole being rectangular in shape and gradually sloping down from a hind portion to a front portion, having a plurality of opposing long slots extending longitudinally in both sides of the front portion, a pair of opposing short slots extending longitudinally in an intermediate portion, a plurality of opposing locating holes beside said long and said short slots, a plurality of connecting holes in the hind portion, the front portion and an intermediate portion;

a vamp having a front portion curved down at both sides, a pair of opposing inserting sides formed at both lower ends of the front portion to insert through said slots of said inner sole, a pair of opposing inserting sides formed to extend down from the intermediate portion;

an outer sole being adhered to a bottom of the front and the intermediate portion of said inner sole having three pairs of screw holes to correspond to said connecting holes of said inner sole for screws to combine the outer sole with said inner sole;

a heel being adhered to a bottom of the hind portion of said inner sole, having three vertical through holes spaces apart for screws to move through for screwing with said inner sole, and three recesses in a bottom surface;

an auxiliary heel being adhered to the bottom of said heel, having three projections on an upper surface to engage said three recesses in said high heel, thereby providing alignment means for the auxiliary heel on the heel; and wherein all the components are tightly and stably combined together by means of screws and adhesive, thereby being prevented from loosening from each other.

* * * * *